US007145291B2

(12) United States Patent
Okada et al.

(10) Patent No.: US 7,145,291 B2
(45) Date of Patent: Dec. 5, 2006

(54) PLASMA DISPLAY PANEL

(75) Inventors: Takeru Okada, Yamanashi-ken (JP); Hikaru Takahashi, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 248 days.

(21) Appl. No.: 10/736,687

(22) Filed: Dec. 17, 2003

(65) Prior Publication Data

US 2004/0124775 A1 Jul. 1, 2004

(30) Foreign Application Priority Data

Dec. 19, 2002 (JP) ..... 2002-368019

(51) Int. Cl.
*H01J 17/49* (2006.01)
*H01J 61/38* (2006.01)
*H01J 61/48* (2006.01)

(52) U.S. Cl. ..... 313/587; 313/586; 313/582

(58) Field of Classification Search ..... 313/587
See application file for complete search history.

(56) References Cited

U.S. PATENT DOCUMENTS 5,982,095 A * 11/1999 Jin et al. ..... 313/582
2002/0003407 A1* 1/2002 Bachmann et al. ..... 313/587

* cited by examiner

*Primary Examiner*—Mariceli Santiago
*Assistant Examiner*—Elizabeth Rielley
(74) *Attorney, Agent, or Firm*—Arent Fox PLLC

(57) ABSTRACT

Discharge-gas-filled discharge cells C each having a phosphor layer 7 formed therein are formed between a front substrate 1 and a back substrate 4. A display discharge is produced between paired display electrodes X and Y and an addressing discharge is produced between the display electrode Y and an addressing electrode D in each discharge cell C. In such a plasma display panel, a diamond-containing layer 17A made of a diamond-containing insulation material is formed in a position where the addressing discharge between the display electrode Y and the addressing electrode D in each discharge cell C is produced.

29 Claims, 10 Drawing Sheets

FIFTH EMBODIMENT

SECTION V-V

FIRST EMBODIMENT

SECOND EMBODIMENT

THIRD EMBODIMENT

FOURTH EMBODIMENT

FIFTH EMBODIMENT

SIXTH EMBODIMENT

SEVENTH EMBODIMENT

EIGHTH EMBODIMENT

NINTH EMBODIMENT

TENTH EMBODIMENT

ELEVENTH EMBODIMENT

TWELFTH EMBODIMENT

THIRTEENTH EMBODIMENT

FOURTEENTH EMBODIMENT

FIFTEENTH EMBODIMENT

SIXTEENTH EMBODIMENT

PLASMA DISPLAY PANEL

BACKGROUND OF THE INVENTION

1. Field of the Invention

This invention relates to a panel structure of plasma display panels.

The present application claims priority from Japanese Application No. 2002-368019, the disclosure of which is incorporated herein by reference.

2. Description of the Related Art

In recent years, plasma display panels (hereinafter referred to as "PDP") have been becoming prevalent as a large-sized and slim color screen display.

PDPs broadly fall into three broad types: a reflective surface discharge type in which display electrode pairs are formed on one of two substrates facing each other with the discharge space in between, and addressing electrodes and phosphor layers are formed on the other substrate; a opposite discharge type in which ones in each display electrode pair are formed on one of two substrates, and the other display electrodes in each display electrode pair and addressing electrodes are formed on the other substrate; and a type in which display electrode pairs and addressing electrodes are formed on one of two substrates.

FIG. 1 is a front view illustrating the structure of a conventional PDP of a reflective surface-discharge type out of the foregoing three discharge types. FIG. 2 is a sectional view taken along the V—V line in FIG. 1.

Referring to FIGS. 1 and 2, a plurality of display electrode pairs (X, Y) each forming a display line L are arranged on the rear surface of a front substrate 1, and covered with a dielectric layer 2. The rear surface of the dielectric layer 2 is covered by an MgO made protective layer 3.

Each of the display electrodes X, Y is constituted of transparent electrodes Xa, Ya and a bus electrode Xb, Yb. Each of the transparent electrodes Xa, Ya is formed of an ITO-made transparent conductive film, and the transparent electrodes Xa and Ya in each display electrode pair are placed on opposite sides of a discharge gap g. The bus electrode Xb, Yb is formed of a metal film to assist the electrical conductivity of the associated transparent electrodes Xa, Ya lined up along and connected to the bus electrode at regular intervals.

A plurality of addressing electrodes D each extend in a direction at right angles to the display electrode pair (X, Y) and are arranged in parallel on the screen-side surface of a back substrate 4. The addressing electrodes D are covered by an addressing electrode protective layer 5.

On the addressing electrode protective layer 5, a partition wall 6 is formed and shaped in a grid form constituted of transverse walls 6A each extending in a row direction (the right-left direction in FIG. 1) and vertical walls 6B each extending in a column direction (the up-down direction in FIG. 1). The partition wall 6 partitions the discharge space, formed between the paired transparent electrodes Xa, Ya and the addressing electrode D lying opposite the paired transparent electrodes Xa, Ya, into discharge cells C.

In each discharge cell C, a red-, green- or blue-colored phosphor layer 7 is formed and overlaid on the side faces of the partition wall 6 and the addressing electrode protective layer 5. The primary three colors, red, green and blue colors, are applied to the individual phosphor layers 7 in order.

The front substrate 1 and the back substrate 4 configured as described above are placed in parallel on the opposite sides of the discharge space. The discharge space between the front substrate 1 and the back substrate 4 is filled with a discharge gas made by mixing neon, xenon and the like (Xe—Ne type gas).

To generate an image on the PDP, first, an addressing discharge for selecting the discharge cells for emitting light (light emission cells) is produced selectively between the addressing electrode D and the display electrode Y. Then, a discharge-sustaining pulse is applied alternately to the display electrodes X and Y, whereby a display discharge is caused between the display electrodes X and Y in the light emission cell.

In order to enhance the luminous efficiency of the display discharge in each discharge cell C for improving the brightness on the screen, the PDPs designed as described above adopt some methods: e.g., an increase of the height of the partition wall 6 to increase the area of the reflection face of the phosphor layer 7 which is formed on the side faces of the partition wall 6; an increase of the proportion of xenon gas which is included in the discharge gas filling the discharge cell C; and an increase of the film thickness of the dielectric layer 2 covering the display electrode pairs (X, Y).

However, such a simple increase in the height of the partition wall, the proportion of xenon gas in the discharge gas, or the film thickness of the dielectric layer 2 for improvement in the luminous efficiency of the display discharge inside the discharge cell C, leads to a decrease in the margin of voltage of the data pulse applied to the addressing electrode D or of a scanning pulse applied to the display electrode Y, because an addressing discharge is caused between the addressing electrode D and the display electrode Y across the discharge space.

This decrease produces a need for raising the voltage of the data pulse or scanning pulse for setting a high starting voltage for the addressing discharge. This in turn produces a need for increasing the resistance, to high voltage, of an addressing driver IC for outputting a data pulse to the addressing electrode and of a scanning driver IC for outputting a scan pulse to the display electrode Y. These needs raise new problems of a resultant increase in production costs, creating an obstacle to realizing the saving of power by the PDP, and the like.

Further, PDPs typically adopt drive techniques, called "a subfield method", for increasing the number of levels of luminance gradation representation to enable the displaying of an image in a gray scale in accordance with an incoming image signal.

In the subfield method, the greater the number of levels of luminance gradation representation, the greater the number of subfields in a frame. Therefore, an increased number of subfields are required for forming a high-quality image. In this event, in view of the fact that a display time period for a frame is predetermined, a time period of light emission in each subfield is shortened to reduce the brightness on the screen, leading to a need for increasing the luminous efficiency in each display discharge.

As a result, in the PDPs driven by the subfield method, especially, the foregoing problems become significantly important.

SUMMARY OF THE INVENTION

The present invention has been made to solve the problems associated with conventional plasma display panels as described above.

Accordingly, it is an object of the present invention to provide a plasma display panel capable of achieving an improvement in luminous efficiency in each display discharge.

Therefore, the present invention provides a plasma display panel having discharge-gas-filled discharge cells each of which includes a phosphor layer formed therein and is formed between two substrates, and producing a display discharge between paired display electrodes and an addressing discharge between one of the paired display electrodes and an addressing electrode in each discharge cell. The plasma display panel has the feature of including a diamond-containing layer made of an insulation material containing diamond, and provided in a position in which the addressing discharge is produced between the display electrode and the addressing electrode in the discharge cell.

With the plasma display panel according to the present invention, when an addressing discharge is caused between the addressing electrode and one of the paired display electrodes in each discharge cell, the diamond included in the diamond-containing layer provided in the position in which the addressing discharge is generated in each discharge cell stimulates the emission of secondary electrons from the discharge gas, and thus it is possible to generate the addressing discharge at a low starting voltage.

Even when the space between the two substrates is widened, the proportion of xenon gas in the discharge gas is increased, or the dielectric layer covering the display electrodes is increased in film thickness in order to improve the luminous efficiency of the display discharge in the discharge cell, the diamond-containing layer makes it possible to produce an addressing discharge without raising the addressing-discharge starting voltage.

These and other objects and features of the present invention will become more apparent from the following detailed description with reference to the accompanying drawings.

DETAILED DESCRIPTION OF THE PREFERRED EMBODIMENTS

Preferred embodiments according to the present invention will be described below in detail with reference to the accompanying drawings.

Figure 3:
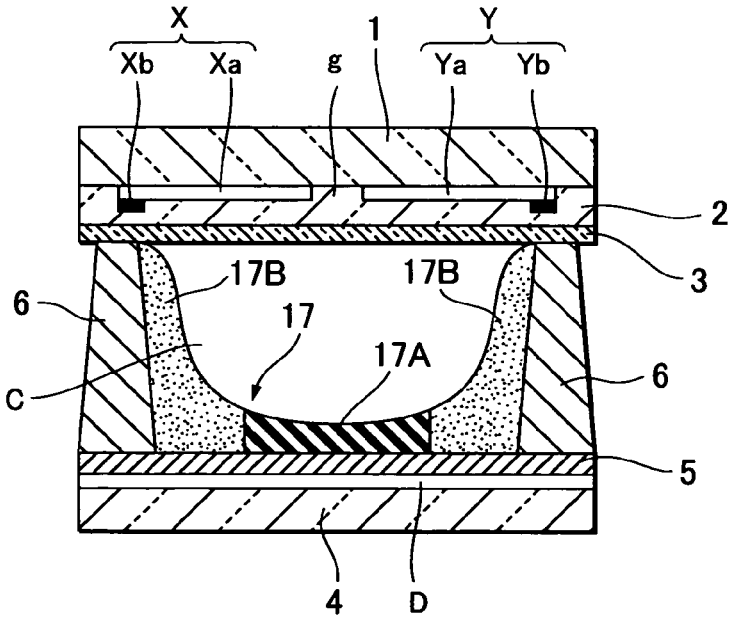
FIG. 3 is a sectional view illustrating a first embodiment of a PDP according to the present invention.

FIG. 3 is a sectional view illustrating a first embodiment of a plasma display panel (PDP) according to the present invention.

Figure 1:
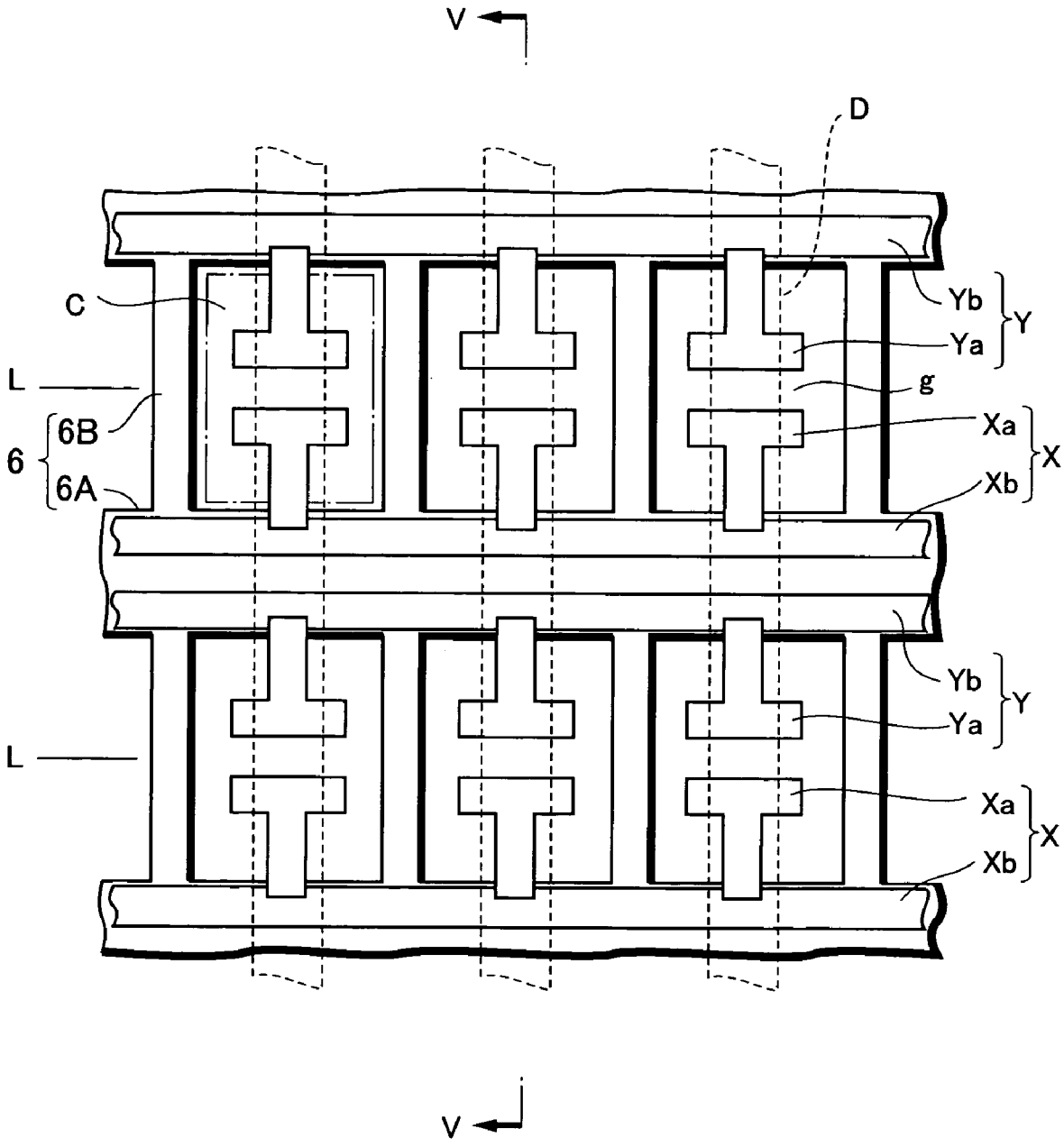
Fig.1 PRIOR ART
FIG. 1 is a schematic front view of the structure of a conventional PDP.
Figure 2:
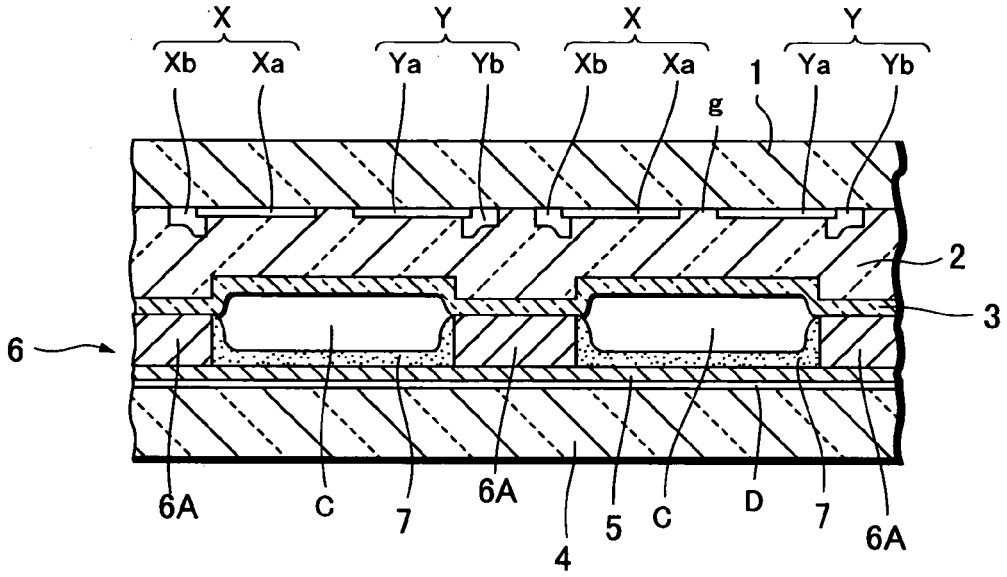
Fig.2 PRIOR ART
FIG. 2 is a sectional view taken along the V—V line in FIG. 1.

The PDP in the first embodiment is a reflection-type surface-discharge PDP as in the case described in FIGS. 1 and 2, in which a plurality of display electrode pairs (X, Y) are regularly arranged on the rear surface of a front substrate 1, and covered by a dielectric layer 2, and the rear surface of the dielectric layer 2 is covered by an MgO-made protective layer 3.

Each of the display electrodes X, Y is constituted of transparent electrodes Xa, Ya, and a bus electrode Xb, Yb. Each of the transparent electrodes Xa, Ya is formed of a transparent conductive film made of ITO or the like having a larger width. The bus electrode Xb, Yb is formed of a metal film of a smaller width to assist the electrical conductivity of the associated transparent electrodes Xa, Ya. The transparent electrodes Xa and Ya are placed opposite each other with a discharge gap g in between.

Addressing electrodes D each extending in a direction at right angles to the display electrode pair (X, Y) are regularly arranged on the screen-side surface of a back substrate 4. The addressing electrodes D are covered by an addressing electrode protective layer 5.

A partition wall 6 partitions the discharge space into discharge cells C each corresponding to an intersection of the display electrode pair (X, Y) and the addressing electrode D. The discharge cells C are filled with a discharge gas made by mixing neon, xenon and the like (Xe—Ne type gas).

The foregoing structure is similar to the structure described in FIG. 2 and the same reference numerals are used.

The PDP in the first embodiment has a phosphor layer 17 formed on the face of the addressing-electrode protective layer 5 and the four side faces of the partition walls 6 in each discharge cell C, and a diamond-containing layer 17A formed in a portion of the phosphor layer 17 situated in a central portion of the addressing-electrode protective layer 5.

The diamond-containing layer 17A is made by adding diamond powder to each of the red, green and blue phosphor materials for forming the phosphor layers 17. The phosphor layer 17 is formed of the diamond-containing layer 17A and the remaining portion 17B formed only of the phosphor material.

The diamond-containing layer 17A is formed by use of screen-printing techniques or various techniques such as ink jetting, nozzle discharging, spin coating, and the like.

The particle size of the diamond powder included in the diamond-containing layer 17A is preferably a mall number of microns (e.g. ranging from 0.1 μm to 3 μm), and diamonds synthesized at high pressure, or alternatively by use of implosion techniques may be used.

The diamond powder includes impurities such as phosphorus (P), nitrogen (N), boron (B) and the like, and as a result of this does not need to be transparent.

Further, the diamond-containing layer 17A may be formed with another powder and/or an MgO glass paste.

The diamond powder included in the diamond-containing layer 17A preferably has a hydrogen-terminated surface. For this hydrogenation, a method of annealing in hydrogen, hydrogen plasma or the like is used.

In the PDP, an addressing discharge between the display electrode Y and the addressing electrode D is produced on both sides of the portion of the phosphor layer 17 in which the diamond-containing layer 17A is formed. Hence, because of the diamond powder included in the diamond-containing layer 17A, the voltage for starting the addressing discharge is lowered as compared with the use of a phosphor layer 17 formed only of phosphor materials.

Specifically, because the addressing-discharge starting voltage depends upon a secondary electron emission coefficient, the diamond powder included in the diamond-containing layer 17A stimulates the emission of secondary electrons from Xe ions in the discharge gas, to thereby reduce the addressing-discharge starting voltage.

Hence, by means of formation of the diamond-containing layer 17A, it is possible to generate an addressing discharge without raising the voltage for starting the addressing discharge, even when the height of the partition wall 6, the proportion of xenon gas in the discharge gas or the film thickness of the dielectric layer 2 is increased for improving the luminous efficiency of the display discharge in each discharge cell C.

Further, when the diamond powder included in the diamond-containing layer 17A has a hydrogen-terminated surface, the diamond powder has a negative electron affinity. For this reason, the emission of secondary electrons from Xe ions is further stimulated, thereby further reducing the addressing-discharge starting voltage.

Moreover if the diamond powder included in the diamond-containing layer 17A has an oxygen-terminated surface, mixing of trace hydrogen (e.g. 4 or less percentages) in the discharge gas allows hydrogenation on the surface of the diamond powder. Hence, the emission of secondary electrons from Xe ions is further stimulated to make it possible to reduce the addressing-discharge starting voltage.

In this connection, the diamond powder in the diamond-containing layer 17A tends to emit electrons by a photoelectric effect or the like and becomes positively charged. Hence, even when the polarity of the addressing electrode D is either negative or positive, the diamond powder exerts the effect of decreasing the addressing-discharge starting voltage, and provides electrons due to the photoelectric effect. The electrons serve as priming particles to improve the start of the addressing discharge. This makes it possible to shorten the addressing discharge period.

However, when the polarity of the addressing electrode D is negative rather than positive, the coefficient of the emission of secondary electrons from Xe ions in the discharge gas is further increased, so that it is possible to further reduce the addressing-discharge starting voltage.

The first embodiment has described the case in which the diamond-containing layer 17A is formed by adding diamond powder to the same phosphor material as that used for forming the remaining portion 17B of the phosphor layer 17. However, if a sufficient area for forming the phosphor in the discharge cell C is ensured, the diamond-containing layer 17A may be formed by use of other materials.

Figure 4:
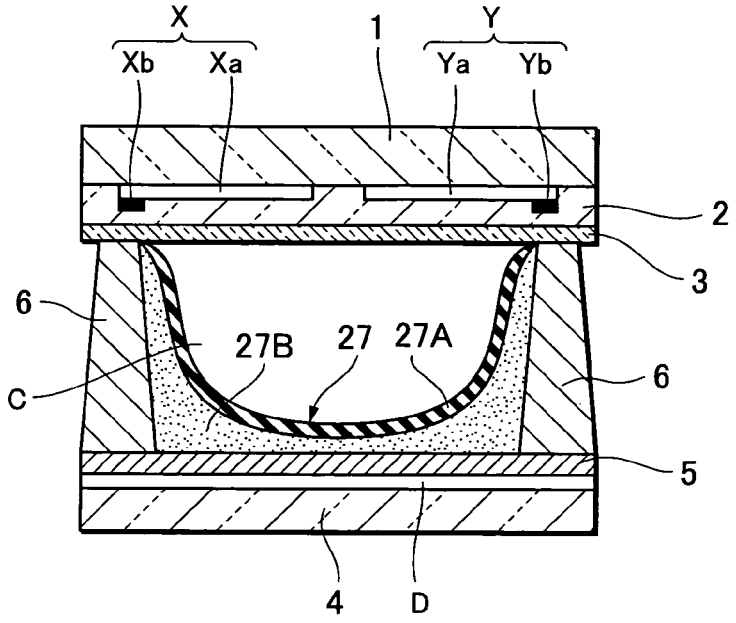
FIG. 4 is a sectional view illustrating a second embodiment of a PDP according to the present invention.

FIG. 4 is a sectional view illustrating a second embodiment of the PDP according to the present invention.

The PDP in the second embodiment is the same reflection type surface discharge PDP as that in the first embodiment, and has approximately the same structure of components excluding the phosphor layer as that of the PDP in the first embodiment and the same reference numerals are used.

The PDP in the second embodiment has a phosphor layer 27 constituted of a phosphor material layer 27B and a diamond-containing layer 27A covering the entire surface of the phosphor material layer 27B. The phosphor material layer 27B is formed of an alternation of red, green and blue phosphor materials so as to cover the surface of the addressing electrode protective layer 5 and the side faces of the partition wall 6 in each discharge cell.

The diamond-containing layer 27A is formed by adding diamond particles to the phosphor material of the same color as each of those of the phosphor material layer 27B, as in the case of the diamond-containing layer 17A in the first embodiment. Regarding the particle size of the diamond powder, the impurities included in the diamond powder, the terminal form of the diamond powder, the characteristics relating to the polarity of the addressing electrode D, and the like, the diamond-containing layer 27A is approximately the same as in the case in the first embodiment.

The diamond-containing layer 27A is formed preferably by use of a Chemical Vapor Deposition (hereinafter referred to as "CVD") process, but alternatively, can be formed by use of screen printing techniques or various techniques such as ink jetting, nozzle discharging, spin coating, and the like.

In the PDP, an addressing discharge between the display electrode Y and the addressing electrode D is produced on both sides of the diamond-containing layer 27A of the phosphor layer 27. Because of the diamond powder included in the diamond-containing layer 27A, the voltage for starting the addressing discharge is lowered as compared with the use of a phosphor layer 27 formed only of phosphor materials. Thus, it is possible to generate an addressing discharge without raising the voltage for starting the addressing discharge, even when the height of the partition wall 6, the proportion of xenon gas in the discharge gas or the film thickness of the dielectric layer 2 is increased.

The mechanism for reducing the addressing-discharge starting voltage is approximately the same as that in the PDP of the first embodiment.

Further, as in the first embodiment, it is possible in the second embodiment to further reduce the addressing-discharge starting voltage by means of mixing trace hydrogen into the discharge gas.

Figure 5:
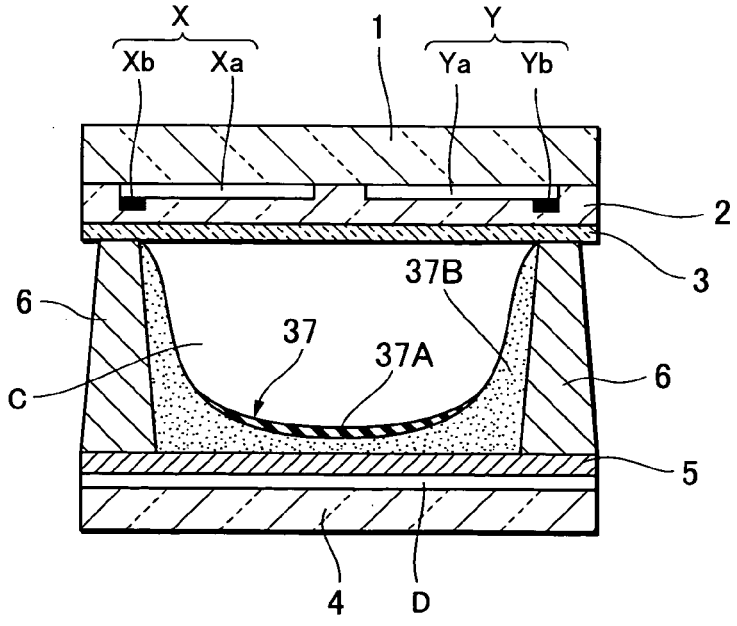
FIG. 5 is a sectional view illustrating a third embodiment of a PDP according to the present invention.

FIG. 5 is a sectional view illustrating a third embodiment of the PDP according to the present invention.

The PDP in the third embodiment is the same reflection type surface discharge PDP as the PDP in the first embodiment, and has approximately the same structure of the components excluding the phosphor layer as that of the PDP in the first embodiment and the same reference numerals are used.

The PDP in the third embodiment has a phosphor layer 37 constituted of a phosphor material layer 37B and a diamond-containing layer 37A. The phosphor material layer 37B is formed of an alternation of red, green and blue phosphor materials so as to cover the surface of the addressing electrode protective layer 5 and the side faces of the partition wall 6 in each discharge cell. The diamond-containing layer 37A is formed in a central portion of the phosphor material layer 37B opposite the addressing electrode protective layer 5 so as to cover part of the surface of the phosphor material layer 37B.

The diamond-containing layer 37A is formed by adding diamond particles to the phosphor material of the same color as each color of the phosphor material layer 37B, as in the case of the diamond-containing layer 17A in the first embodiment. Regarding the particle size of the diamond powder, the impurities included in the diamond powder, the terminal form of the diamond powder, the characteristics relating to the polarity of the addressing electrode D, and the like, the diamond-containing layer 37A is approximately the same as in the case of the first embodiment.

The diamond-containing layer 37A is formed preferably by use of a CVD process, but alternatively, can be formed by use of screen printing techniques or various techniques such as ink jetting, nozzle discharging, spin coating, and the like.

In the PDP, an addressing discharge between the display electrode Y and the addressing electrode D is produced on both sides of the diamond-containing layer 37A formed on the phosphor material layer 37B of the phosphor layer 37. Because of the diamond powder included in the diamond-containing layer 37A, the voltage for starting the addressing discharge is lowered as compared with the use of a phosphor layer 37 formed only of phosphor materials. Thus, it is possible to generate an addressing discharge without increasing the voltage for starting the addressing discharge, even when the height of the partition wall 6, the proportion of xenon gas in the discharge gas or the film thickness of the dielectric layer 2 is increased.

The mechanism for reducing the addressing-discharge starting voltage is approximately the same as that in the PDP of the first embodiment.

Further, as in the first embodiment, it is also possible in the third embodiment to further reduce the addressing-discharge starting voltage by means of mixing trace hydrogen into the discharge gas.

The third embodiment has described the case in which the diamond-containing layer 37A of the phosphor layer 37 is formed by adding diamond powder to the same phosphor material as that used for forming the phosphor material layer 37B. However, if a sufficient phosphor area of the phosphor of the phosphor material layer 37B in the discharge cell C is ensured, the diamond-containing layer 37A may be formed by use of other insulation materials.

Figure 6:
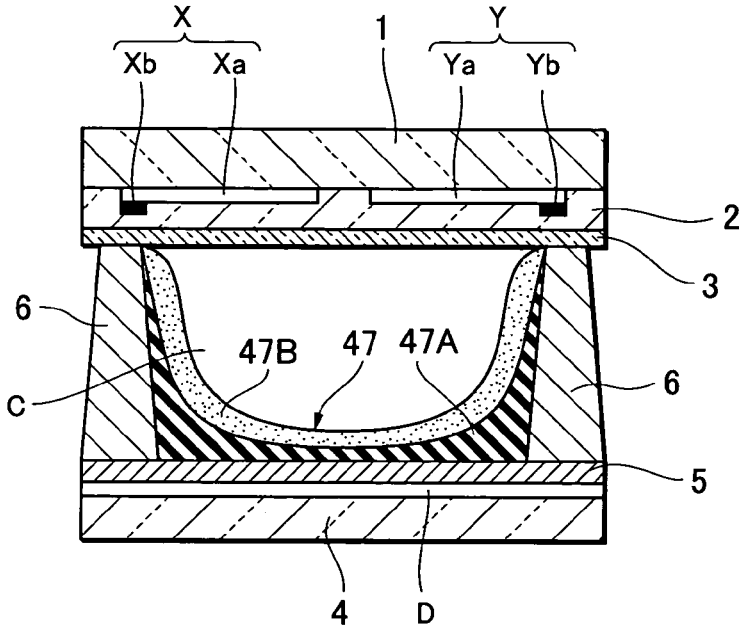
FIG. 6 is a sectional view illustrating a fourth embodiment of a PDP according to the present invention.

FIG. 6 is a sectional view illustrating a fourth embodiment of the PDP according to the present invention.

The PDP in the fourth embodiment is the same reflection type surface discharge PDP as the PDP in the first embodiment, and has approximately the same structure of components excluding the phosphor layer as that of the PDP in the first embodiment and the same reference numerals are used.

The PDP in the fourth embodiment has a phosphor layer 47 constituted of a diamond-containing layer 47A and a phosphor material layer 47B. The diamond-containing layer 47A is formed so as to cover the surface of the addressing electrode protective layer 5 and the side faces of the partition wall 6 in each discharge cell C. The phosphor material layer 47B is formed of an alternation of red, green and blue phosphor materials so as to cover the surface of the diamond-containing layer 47A.

The diamond-containing layer 47A may be formed by adding diamond particles to the phosphor material of the same color as that of the phosphor material layer 47B, or alternatively by adding diamond particles to another insulation material. Regarding the particle size of the diamond powder, the method of forming the diamond-containing layer, the impurities included in the diamond powder, the terminal form of the diamond powder, the characteristics relating to the polarity of the addressing electrode D, and the like, the diamond-containing layer 47A is approximately the same as in the case of the first embodiment.

In the PDP, an addressing discharge between the display electrode Y and the addressing electrode D is produced on both sides of the diamond-containing layer 47A of the phosphor layer 47. Because of the diamond powder included in the diamond-containing layer 47A, the voltage for starting the addressing discharge is reduced as compared with the use of a phosphor layer 47 formed only of phosphor materials. Thus, it is possible to generate an addressing discharge without increasing the voltage for starting the addressing discharge, even when the height of the partition wall 6, the proportion of xenon gas in the discharge gas or the film thickness of the dielectric layer 2 is increased.

The mechanism for reducing the addressing-discharge starting voltage is approximately the same as that in the PDP of the first embodiment.

Further, as in the first embodiment, it is possible in the fourth embodiment to further reduce the addressing-discharge starting voltage by means of mixing trace hydrogen into the discharge gas.

Figure 7:
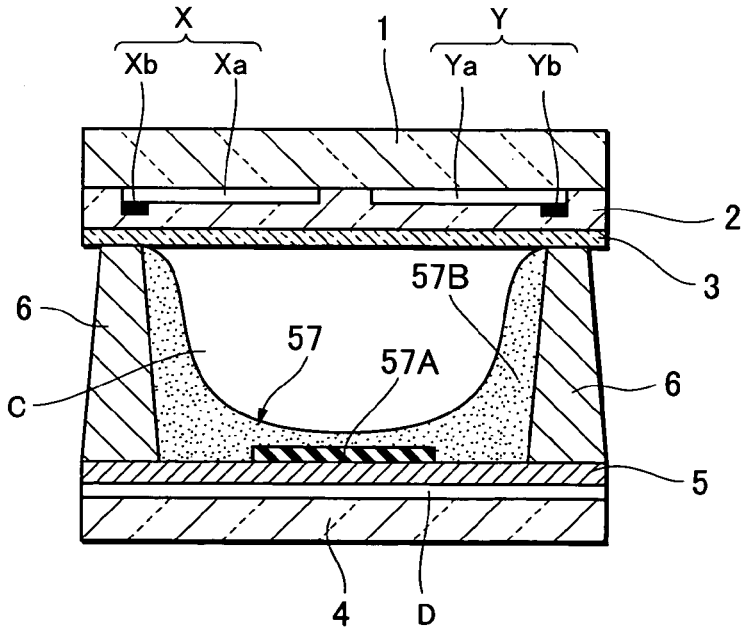
FIG. 7 is a sectional view illustrating a fifth embodiment of a PDP according to the present invention.

FIG. 7 is a sectional view illustrating a fifth embodiment of the PDP according to the present invention.

The PDP in the fifth embodiment is the same reflection type surface discharge PDP as the PDP in the first embodiment, and has approximately the same structure of components excluding the phosphor layer as that of the PDP in the first embodiment and the same reference numerals are used.

The PDP in the fifth embodiment has a phosphor layer 57 constituted of a diamond-containing layer 57A and a phosphor material layer 57B. The diamond-containing layer 57A is formed in a plate shape in an approximately central portion of the addressing electrode protective layer 5 located inside the discharge cell C. The phosphor material layer 57B is formed of an alternation of red, green and blue phosphor materials so as to cover the diamond-containing layer 57A, the addressing electrode protective layer 5 and the side faces of the partition wall 6.

The diamond-containing layer 57A may be formed by adding diamond particles to the phosphor material of the same color as that of the phosphor material layer 57B, or alternatively by adding diamond powder to another insulation material. Regarding the particle size of the diamond powder, the forming method of the diamond-containing layer, the impurities included in the diamond powder, the terminal form of the diamond powder, the characteristics relating to the polarity of the addressing electrode D, and the like, the diamond-containing layer 57A is approximately the same as in the case of the first embodiment.

In the PDP, an addressing discharge between the display electrode Y and the addressing electrode D is produced on both sides of the diamond-containing layer 57A of the phosphor layer 57. Because of the diamond powder included in the diamond-containing layer 57A, the voltage for starting the addressing discharge is lowered as compared with the use of a phosphor layer 57 formed only of phosphor materials. Thus, it is possible to generate an addressing discharge without increasing the voltage for starting the addressing discharge, even when the height of the partition wall 6, the proportion of xenon gas in the discharge gas or the film thickness of the dielectric layer 2 is increased.

The mechanism for reducing the addressing-discharge starting voltage is approximately the same as that in the PDP of the first embodiment.

Further, as in the first embodiment, it is also possible in the fifth embodiment to further reduce the addressing-discharge starting voltage by means of mixing trace hydrogen into the discharge gas.

Figure 8:
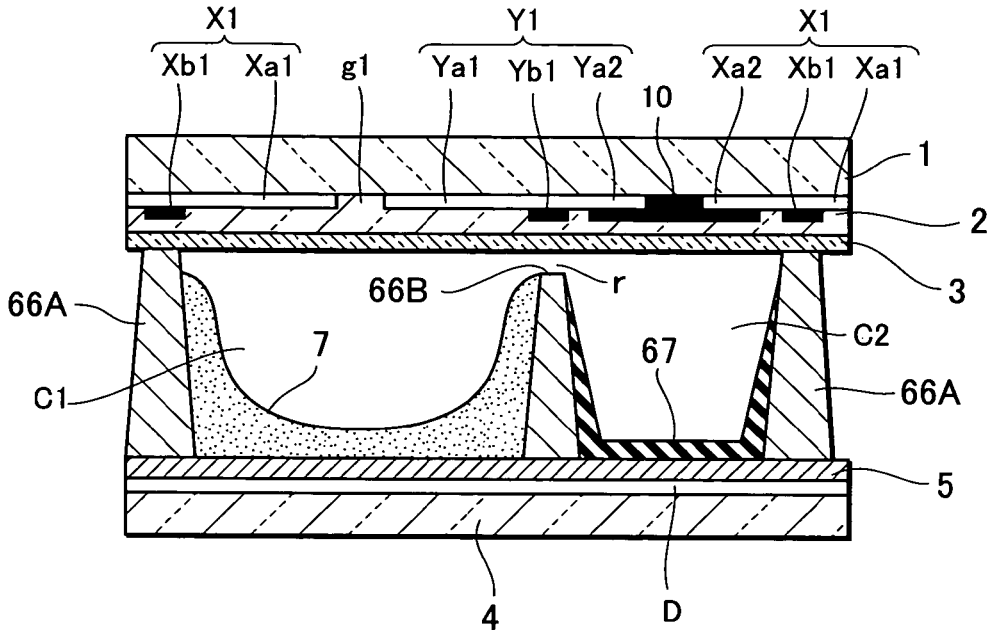
FIG. 8 is a sectional view illustrating a sixth embodiment of a PDP according to the present invention.

FIG. 8 is a sectional view illustrating a sixth embodiment of the PDP according to the present invention.

The PDP in the sixth embodiment is the same reflection type surface discharge PDP as the PDP in the first embodiment. The PDP in the first embodiment generates a display discharge and an addressing discharge inside the same discharge cell, whereas the PDP in the sixth embodiment is structured such that a display discharge cell C1 for causing the display discharge and an addressing discharge cell C2 for causing the addressing discharge are individually formed.

The PDP in the sixth embodiment includes a first transverse wall 66A for creating a partition between adjacent display lines. In addition, a second transverse wall 66B of a height lower than that of the first transverse wall 66A provides a partition between the display discharge cell C1 and the addressing discharge cell C2, which are structured to make a pair. The display discharge cell C1 and the addressing discharge cell C2 communicate with each other by means of a clearance r formed between the second transverse wall 66B and a protective layer 3.

The display discharge cell C1 faces paired transparent electrodes Xa1 and Ya1 of each display electrode pair (X1, Y1). The addressing discharge cell C2 faces projecting portions Xa2 and Ya2 of the respective transparent electrodes Xa1 and Ya1 of the respective and adjacent display electrode pairs (X1, Y1), the projecting portions Xa2 and Ya2 being extensions from the respective bus electrodes Xb1 and Yb1 in the direction of the other of the adjacent display electrode pairs concerned.

A phosphor layer 7 is formed in the display discharge cell C1. A diamond-containing layer 67 is formed in the addressing discharge cell C2 and covers the surface of the addressing electrode protective layer 5 and the side faces of the first and second transverse walls 66A and 66B (and also of vertical walls not shown).

The diamond-containing layer 67 is formed by adding diamond powder to the insulation material. Regarding the particle size of the diamond powder, the forming method of the diamond-containing layer, the impurities included in the diamond powder, the terminal form of the diamond powder, the characteristics relating to the polarity of the addressing electrode D, and the like, the diamond-containing layer 67 is approximately the same as in the case of the first embodiment.

In addition, a black-colored light absorption layer 10 is formed between the front substrate 1 and the dielectric layer 2 and opposite the addressing discharge cell C2.

The PDP in the sixth embodiment generates a display discharge between the transparent electrodes Xa1 and Ya1 facing each other with a discharge gap in between in the display discharge cell C1. An addressing discharge is generated, in the addressing discharge cell C2, between the addressing electrode D and the projecting portion Ya2 extending from the associated bus electrode Yb1 connected to the transparent electrode Ya1 in the direction of the other display electrode pair (X1, Y1) adjacent thereto.

In this manner, the PDP generates an addressing discharge, in the addressing discharge cell C2, between the projecting portion Ya2 of the transparent electrode Ya1 and the addressing electrode D on both sides of the diamond-containing layer 67. The diamond powder included in the diamond-containing layer 67 makes it possible to reduce the addressing-discharge starting voltage as compared with the case where there is no diamond-containing layer 67.

Thus, even when the height of the first transverse wall 66A, the proportion of xenon gas in the discharge gas or the film thickness of the dielectric layer 2 is increased in order to enhance the luminous efficiency of the display discharge in the display discharge cell C1, it is possible to produce an addressing discharge at a low voltage for starting the addressing discharge.

The mechanism for reducing the addressing-discharge starting voltage is approximately the same as that in the PDP of the first embodiment.

Further, as in the first embodiment, it is also possible in the sixth embodiment to further reduce the addressing-discharge starting voltage by means of mixing trace hydrogen into the discharge gas.

Figure 9:
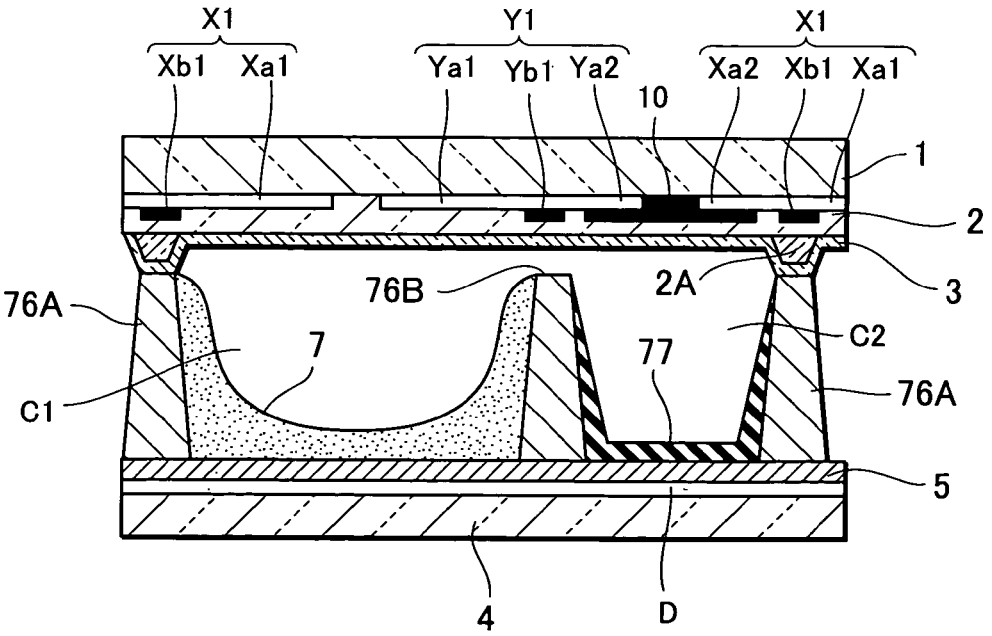
FIG. 9 is a sectional view illustrating a seventh embodiment of a PDP according to the present invention.

FIG. 9 is a sectional view illustrating a seventh embodiment of the PDP according to the present invention.

The PDP in the seventh embodiment is a reflection type surface discharge PDP having pairs of display discharge cells C1 and addressing discharge cells C2 as in the case of the sixth embodiment.

The PDP in the seventh embodiment includes a first transverse wall 76A for creating a partition between adjacent display lines, and a second transverse wall 76B for creating a partition between the display discharge cell C1 and the addressing discharge cell C2 which are paired. The second transverse wall 76B is formed of the same height as that of the first transverse wall 76A. An additional dielectric layer 2A projects from the rear face of the dielectric layer 2 toward the inside of the discharge space, to come in contact with the top face of the first transverse wall 76A to block the adjacent display lines from each other.

A phosphor layer 7 is formed in the display discharge cell C1. A diamond-containing layer 77 is formed in the addressing discharge cell C2. The diamond-containing layer 77 is formed by adding diamond powder to the insulation material.

The structure of the other components of the PDP is similar to that in the PDP in the sixth embodiment and the same reference numerals are used.

Because of the diamond-containing layer 77 formed in the addressing discharge cell C2, the PDP in the seventh embodiment is capable of producing an addressing discharge at a low addressing-discharge starting voltage.

Figure 10:
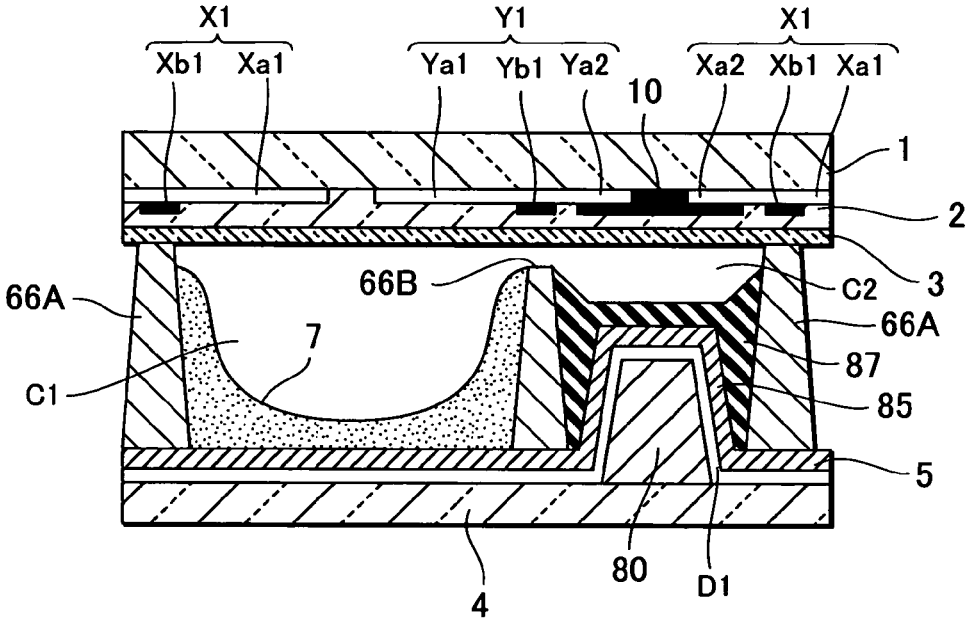
FIG. 10 is a sectional view illustrating an eighth embodiment of a PDP according to the present invention.

FIG. 10 is a sectional view illustrating an eighth embodiment of the PDP according to the present invention.

In addition to the structure of the foregoing PDP of the sixth embodiment, the PDP in the eighth embodiment has a projecting rib 80 projecting from the back substrate 4 into the addressing discharge cell C2. The projecting rib 80 pushes up an addressing electrode D1 and an addressing electrode protective layer 85 in the direction of the front substrate 1.

A phosphor layer 7 is formed in a display discharge cell C1. A diamond-containing layer 87 is formed in an addressing discharge cell C2. The diamond-containing layer 87 is formed by adding diamond powder to the insulation material.

The structure of the other components of the PDP is similar to that in the PDP in the sixth embodiment and the same reference numerals are used.

The PDP in the eighth embodiment is capable of producing an addressing discharge at a low addressing-discharge starting voltage because of the diamond-containing layer 87 formed in the addressing discharge cell C2 as in the case of the PDP in the sixth embodiment. In addition, the PDP is capable of further reducing the addressing-discharge starting voltage because the addressing electrode D1 is pushed up by the projecting rib 80 to come close to the projecting portion Ya2 of the transparent electrode Ya1.

Figure 11:
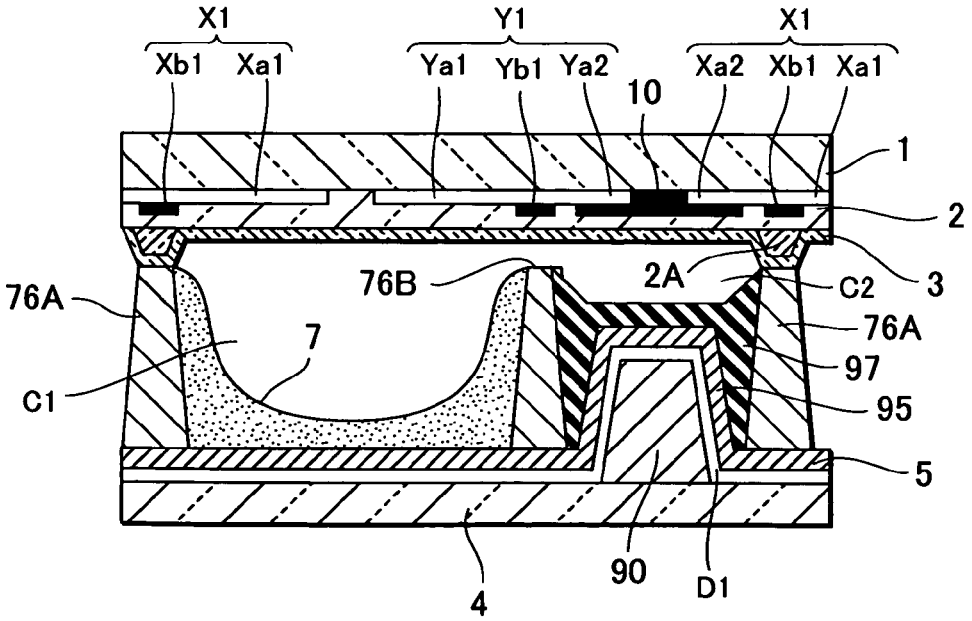
FIG. 11 is a sectional view illustrating a ninth embodiment of a PDP according to the present invention.

FIG. 11 is a sectional view illustrating a ninth embodiment of the PDP according to the present invention.

In addition to the structure of the foregoing PDP of the seventh embodiment, the PDP in the ninth embodiment has a projecting rib 90 projecting from the back substrate 4 into the addressing discharge cell C2. The projecting rib 90 pushes up the addressing electrode D1 and an addressing electrode protective layer 95 in the direction of the front substrate 1.

A phosphor layer 7 is formed in a display discharge cell C1. A diamond-containing layer 97 is formed in an addressing discharge cell C2. The diamond-containing layer 97 is formed by adding diamond powder to the insulation material.

The structure of the other components of the PDP is similar to that in the PDP in the seventh embodiment and the same reference numerals are used.

The PDP in the ninth embodiment is capable of producing an addressing discharge at a low addressing-discharge starting voltage because of the diamond-containing layer 97 formed in the addressing discharge cell C2 as in the case of the PDP in the seventh embodiment. In addition, the addressing-discharge starting voltage is further decreased because the addressing electrode D1 is pushed up by the projecting rib 90 to come close to the projecting portion Ya2 of the transparent electrode Ya1.

Figure 12:
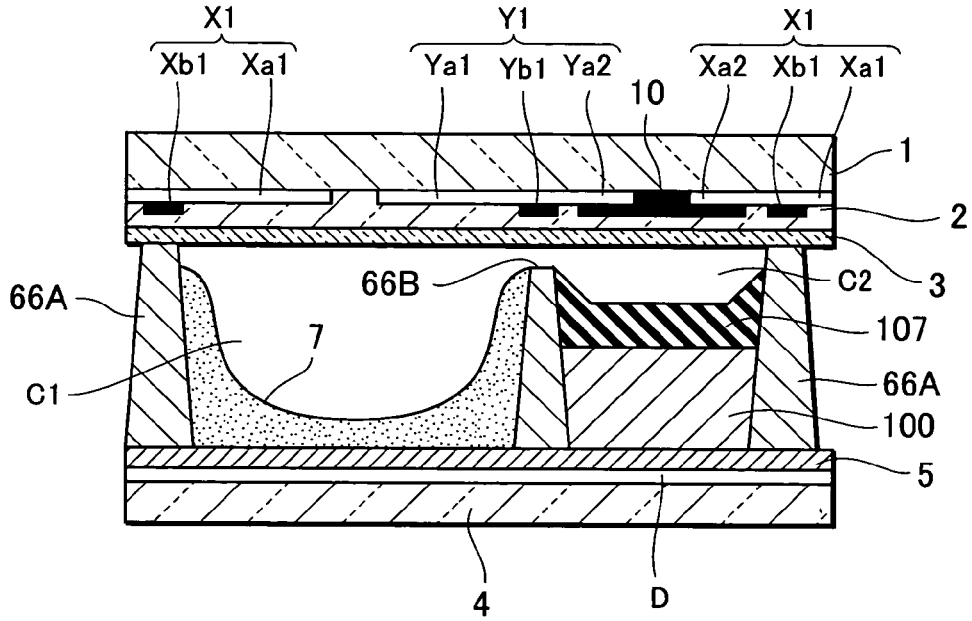
FIG. 12 is a sectional view illustrating a tenth embodiment of a PDP according to the present invention.

FIG. 12 is a sectional view illustrating a tenth embodiment of the PDP according to the present invention.

In addition to the structure of the foregoing PDP of the sixth embodiment, the PDP in the tenth embodiment has a ferroelectric layer 100 made of ferroelectric materials and formed on the addressing electrode protective layer 5 in the addressing discharge cell C2. A diamond-containing layer 107 is formed on the ferroelectric layer 100. The diamond-containing layer 107 is formed by adding diamond powder to the insulation material.

The structure of the other components of the PDP is similar to that in the PDP in the sixth embodiment and the same reference numerals are used.

The PDP in the tenth embodiment is capable of producing an addressing discharge at a low addressing-discharge starting voltage because of the diamond-containing layer 107 formed in the addressing discharge cell C2 as in the case of the PDP in the sixth embodiment. In addition, the addressing-discharge starting voltage is further decreased because the formation of the ferroelectric layer 100 shortens an apparent discharge distance between the projecting portion Ya2 of the transparent electrode Ya1 and the addressing electrode D.

Figure 13:
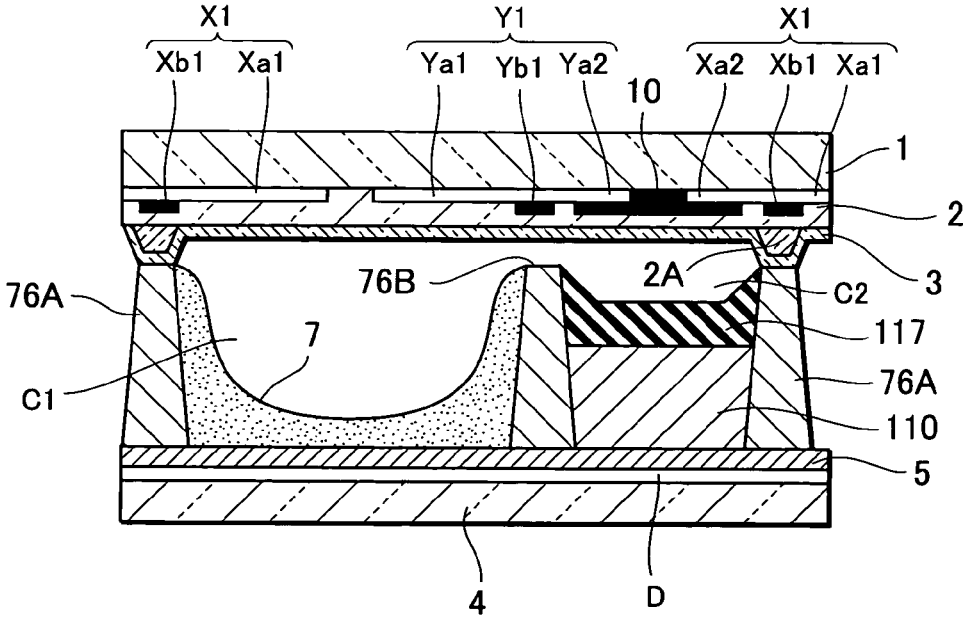
FIG. 13 is a sectional view illustrating an eleventh embodiment of a PDP according to the present invention.

FIG. 13 is a sectional view illustrating an eleventh embodiment of the PDP according to the present invention.

In addition to the structure of the foregoing PDP of the seventh embodiment, the PDP in the eleventh embodiment has a ferroelectric layer 110 made of ferroelectric materials and formed on the addressing electrode protective layer 5 in the addressing discharge cell C2. A diamond-containing layer 117 is formed on the ferroelectric layer 110. The diamond-containing layer 117 is formed by adding diamond powder to the insulation material.

The structure of the other components of the PDP is similar to that in the PDP in the seventh embodiment and the same reference numerals are used.

The PDP in the eleventh embodiment is capable of producing an addressing discharge at a low addressing-discharge starting voltage because of the diamond-containing layer 117 formed in the addressing discharge cell C2 as in the case of the PDP in the seventh embodiment. In addition, the addressing-discharge starting voltage is further decreased because the formation of the ferroelectric layer 110 shortens an apparent discharge distance between the projecting portion Ya2 of the transparent electrode Ya1 and the addressing electrode D.

Figure 14:
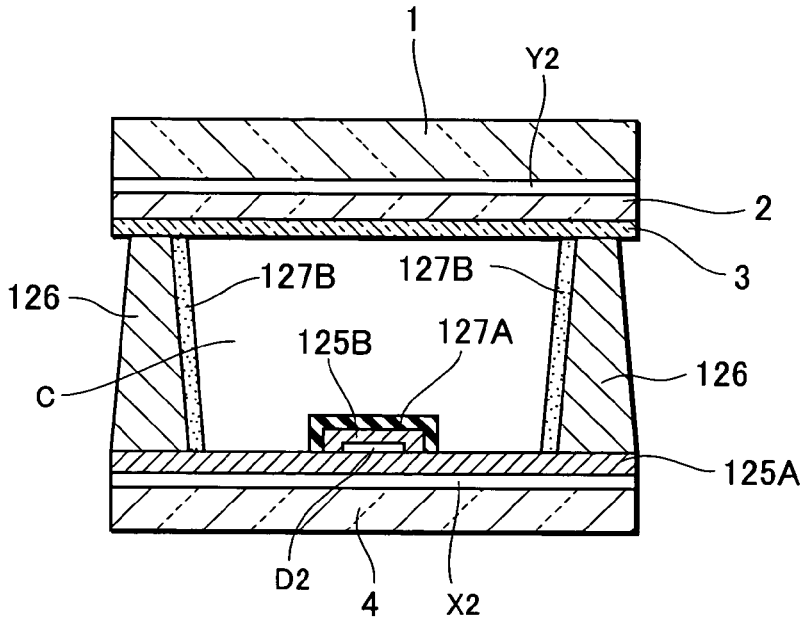
FIG. 14 is a sectional view illustrating a twelfth embodiment of a PDP according to the present invention.

FIG. 14 is a sectional view illustrating a twelfth embodiment of the PDP according to the present invention.

The PDP in the twelfth embodiment is an opposite discharge PDP. One display electrode Y2 in the display electrode pair (X2, Y2) is formed on the rear surface of the front substrate 1, and covered by the dielectric layer 2 and the protective layer 3. The other display electrode X2 is formed on the back substrate 4 and lies opposite to and in the same direction as the display electrode Y2. A dielectric layer 125A covers the display electrodes X2.

An addressing electrode D2 lies on the dielectric layer 125A in a direction at right angles to the display electrodes X2 and Y2. Three sides of the addressing electrode D2 are covered by an addressing electrode protective layer 125B. In turn, the three sides of the addressing electrode protective layer 125B are covered by a diamond-containing layer 127A.

Discharge cells C are formed at intersections of the display electrodes X2, Y2 and the addressing electrodes D2, and defined by a partition wall 126. A phosphor layer 127B is formed on the faces of the partition wall 126 facing each discharge cell C.

The diamond-containing layer 127A may be formed by adding diamond powder to a phosphor material of the same color as that of the phosphor layer 127B, or alternatively may be formed by adding diamond powder to another insulation material.

Regarding the particle size of the diamond powder, the impurities included in the diamond powder, the terminal form of the diamond powder, the characteristics relating to the polarity of the addressing electrode D2, and the like, the diamond-containing layer 127A is approximately the same as in the case of the first embodiment.

The diamond-containing layer 127A is formed preferably by use of a CVD process, but alternatively, can be formed by use of screen printing techniques or various techniques such as ink jetting, nozzle discharging, spin coating, and the like.

In the PDP, an addressing discharge between the display electrode Y and the addressing electrode D2 is produced on both sides of the diamond-containing layer 127A. Therefore, an addressing discharge is generated at a low addressing discharge starting voltage because of the diamond powder included in the diamond-containing layer 127A. Thus, it is possible to generate an addressing discharge without increasing the addressing discharge starting voltage, even when the height of the partition wall 126, the proportion of xenon gas in the discharge gas or the film thickness of the dielectric layer 2 is increased in order to enhance the luminous efficiency of the display discharge generated between the display electrodes X2 and Y2.

The mechanism for reducing the addressing-discharge starting voltage is approximately the same as that in the PDP of the first embodiment.

Further, as in the first embodiment, it is possible in the twelfth embodiment to further reduce the addressing-discharge starting voltage by means of mixing trace hydrogen into the discharge gas.

Figure 15:
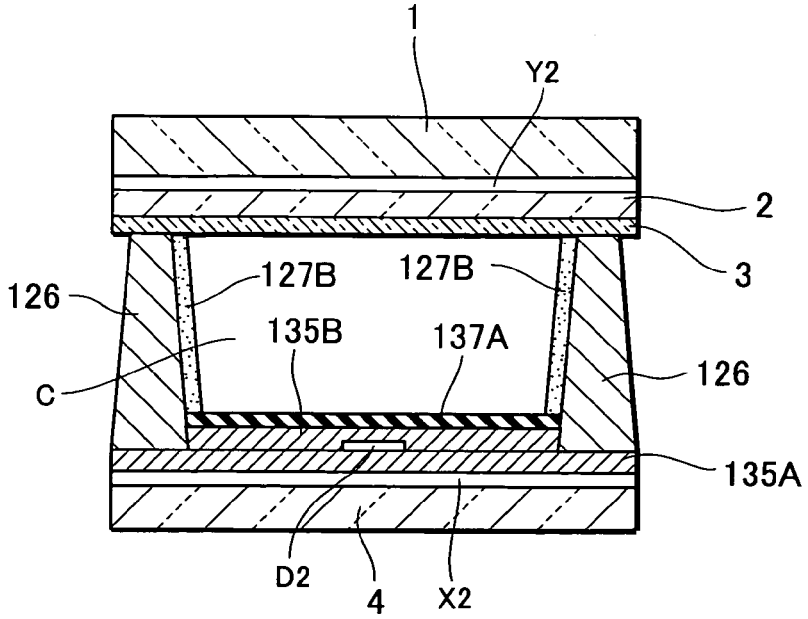
FIG. 15 is a sectional view illustrating a thirteenth embodiment of a PDP according to the present invention.

FIG. 15 is a sectional view illustrating a thirteenth embodiment of the PDP according to the present invention.

The PDP in the thirteenth embodiment is an opposite discharge PDP as in the case of the PDP in the twelfth embodiment. A dielectric layer 135A covers the display electrodes X2. An addressing electrode protective layer 135B covering the addressing electrodes D2 is provided over the entire surface the dielectric layer 135A facing each discharge cell. Further, the entire surface of the addressing electrode protective layer 135B is covered with a diamond-containing layer 137A.

The structure of the other components of the PDP in the thirteenth embodiment is approximately the same as that in the twelfth embodiment and denoted by the same reference numerals.

The diamond-containing layer 137A may be formed by adding diamond powder to a phosphor material of the same color as that of the phosphor layer 127B, or alternatively may be formed by adding diamond powder to another insulation material.

Regarding the particle size of the diamond powder, the impurities included in the diamond powder, the terminal form of the diamond powder, the characteristics relating to the polarity of the addressing electrode D2, and the like, the diamond-containing layer 137A is approximately the same as in the case of the first embodiment.

The diamond-containing layer 137A is formed preferably by use of a CVD process, but alternatively, can be formed by use of screen printing techniques or various techniques such as ink jetting, nozzle discharging, spin coating, and the like.

In the PDP, an addressing discharge between the display electrode Y2 and the addressing electrode D2 is produced on both sides of the diamond-containing layer 137A. Therefore, an addressing discharge is generated at a low addressing discharge starting voltage because of the diamond powder included in the diamond-containing layer 137A. Thus, it is possible to generate an addressing discharge without increasing the addressing discharge starting voltage, even when the height of the partition wall 126, the proportion of xenon gas in the discharge gas or the film thickness of the dielectric layer 2 is increased in order to enhance the luminous efficiency of the display discharge generated between the display electrodes X2 and Y2.

The mechanism for reducing the addressing-discharge starting voltage is approximately the same as that in the PDP of the first embodiment.

Further, as in the first embodiment, it is possible in the thirteenth embodiment to further reduce the addressing-discharge starting voltage by means of mixing trace hydrogen into the discharge gas.

Figure 16:
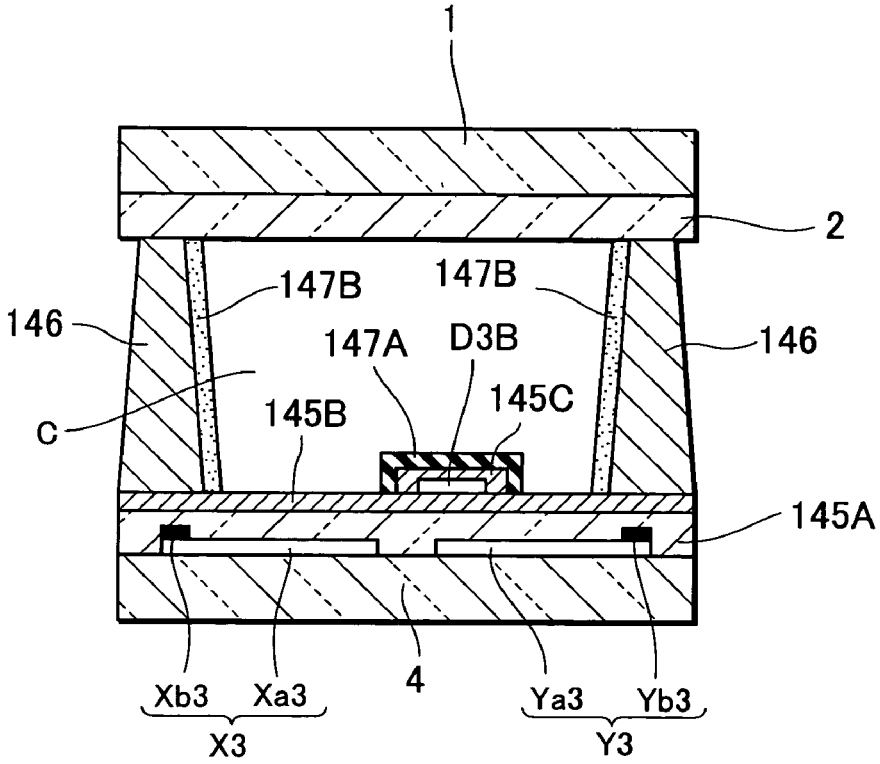
FIG. 16 is a sectional view illustrating a fourteenth embodiment of a PDP according to the present invention.
Figure 17:
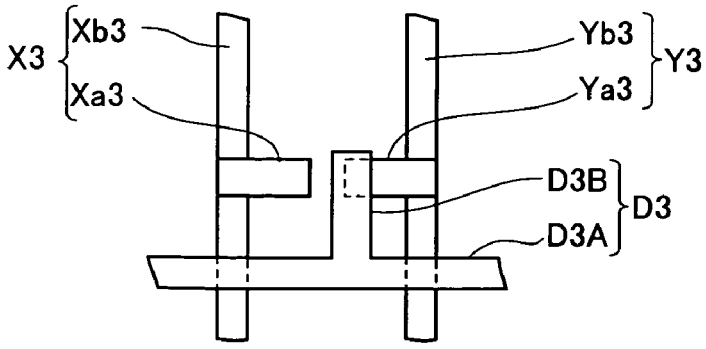
FIG. 17 is a front view illustrating an addressing electrode in the fourteenth embodiment.

FIGS. 16 and 17 are a sectional view and a front view illustrating a fourteenth embodiment of the PDP according to the present invention.

The PDP in the fourteenth embodiment is a type having display electrode pairs (X3, Y3) and addressing electrodes D3 both formed on the back substrate 4. Each display electrode in the display electrode pair (X3, Y3) is constituted of transparent electrodes Xa3, Ya3 and a bus electrode Xb3, Yb3 and structured approximately in the same fashion as the display electrode pair in the first embodiment. The display electrode pairs (X3, Y3) are formed on the back substrate 4, and covered by a dielectric layer 145A.

In turn, a protective layer 145B covers the surface of the dielectric layer 145A. Then, an addressing electrode D3 shaped as illustrated in FIG. 17 is formed on the protective layer 145B.

In FIG. 17, the addressing electrode D3 is constituted of an electrode body D3A and projections D3B. The electrode body D3A extends in a direction at right angles to the display electrodes X3, Y3. The projection D3B extends at right angles from the electrode body D3A to a position in which its leading end overlaps the transparent electrode Ya3.

The addressing electrode D3 is covered by an addressing electrode protective layer 145C. A diamond-containing layer 147A is provided over the surface of the addressing electrode protective layer 145C.

The discharge cell C is formed in a position corresponding to the intersection of the transparent electrode Ya3 and the projection D3B of the addressing electrode D3, and defined by a partition wall 146. In each discharge cell C, a phosphor layer 147B is formed on the side faces of the partition wall 146 facing the discharge cell C.

The diamond-containing layer 147A may be formed by adding diamond powder to a phosphor material of the same color as that of the phosphor layer 147B, or alternatively may be formed by adding diamond powder to another insulation material.

Regarding the particle size of the diamond powder, the impurities included in the diamond powder, the terminal form of the diamond powder, the characteristics relating to the polarity of the addressing electrode D3, and the like, the diamond-containing layer 147A is approximately the same as in the case of the first embodiment.

The diamond-containing layer 147A is formed preferably by use of a CVD process, but alternatively, can be formed by use of screen printing techniques or various techniques such as ink jetting, nozzle discharging, spin coating, and the like.

The PDP produces an addressing discharge between the transparent electrode Ya3 of the display electrode Y3 and the projection D3B of the addressing electrode D3 on the back substrate 4. At this point, the addressing discharge is generated at a low addressing discharge starting voltage because of the diamond powder included in the diamond-containing layer 147A.

Thus, it is possible to generate an addressing discharge without increasing the addressing discharge starting voltage, even when the height of the partition wall 146, the proportion of xenon gas in the discharge gas or the film thickness of the dielectric layer 145A is increased in order to enhance the luminous efficiency of the display discharge generated between the display electrodes X3 and Y3.

The mechanism for reducing the addressing-discharge starting voltage is approximately the same as that in the PDP of the first embodiment.

Further, as in the first embodiment, it is possible in the fourteenth embodiment to further reduce the addressing-discharge starting voltage by means of mixing trace hydrogen into the discharge gas.

Figure 18:
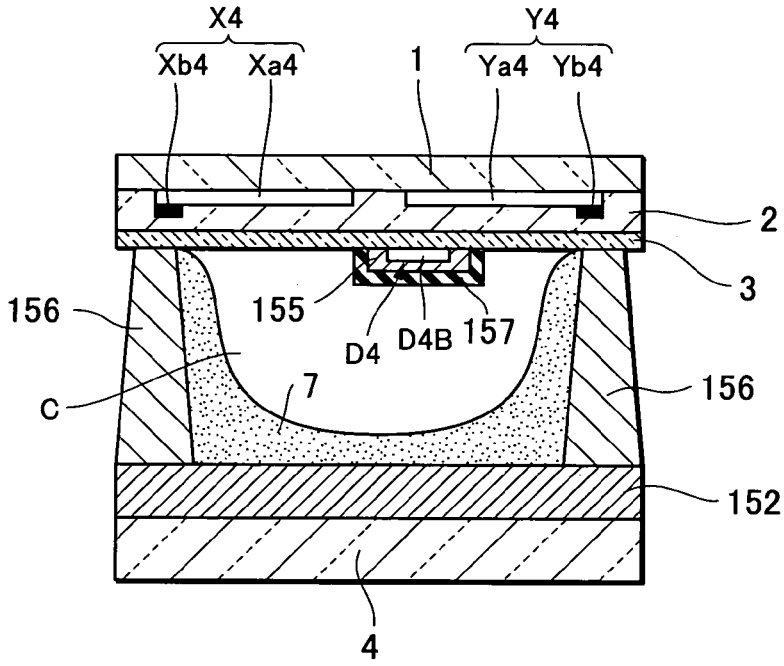
FIG. 18 is a sectional view illustrating a fifteenth embodiment of a PDP according to the present invention.

FIG. 18 is a sectional view illustrating a fifteenth embodiment of the PDP according to the present invention.

The PDP in the fifteenth embodiment is a type similar to the PDP in the fourteenth embodiment but differs in that the display electrode pairs (X4, Y4) and addressing electrodes D4 are formed on the front substrate 1. The display electrode pairs (X4, Y4) are formed on the front substrate 1 in a form similar to the display electrode pair of the first embodiment, and covered by the dielectric layer 2.

The addressing electrodes D4 are formed on the back face of the protective layer 3 covering the dielectric layer 2.

The addressing electrode D4 is shaped in much the same fashion as the addressing electrode D3 illustrated in FIG. 17. That is, the addressing electrode D4 is constituted of an electrode body (not shown) and projections D4B. The electrode body extends in a direction at right angles to the display electrodes Xb4 and Yb4. The projection D4B extends at right angles from the electrode body to a position in which its leading end overlaps the transparent electrode Ya4.

The addressing electrode D4 is covered by an addressing electrode protective layer 155. A diamond-containing layer 157 is provided over the surface of the addressing electrode protective layer 155.

The discharge cell C is formed in a position corresponding to the intersection of the transparent electrode Ya4 and the projection D4B of the addressing electrode D4, and defined by a partition wall 156. In each discharge cell C, the phosphor layer 7 is formed on the side faces of the partition wall 156 and the surface of a dielectric layer 152 covering the back substrate 4.

The diamond-containing layer 157 may be formed by adding diamond powder to a phosphor material of the same color as that of the phosphor layer 7, or alternatively may be formed by adding diamond powder to another insulation material.

Regarding the particle size of the diamond powder, the impurities included in the diamond powder, the terminal form of the diamond powder, the characteristics relating to the polarity of the addressing electrode D4, and the like, the diamond-containing layer 157 is approximately the same as in the case of the first embodiment.

The diamond-containing layer 157 is formed preferably by use of a CVD process, but alternatively, can be formed by use of screen printing techniques or various techniques such as ink jetting, nozzle discharging, spin coating, and the like.

The PDP produces an addressing discharge between the transparent electrode Ya4 of the display electrode Y4 and the projection D4B of the addressing electrode D4 on the front substrate 1. At this point, the addressing discharge is generated at a low addressing discharge starting voltage because of the diamond powder included in the diamond-containing layer 157.

Thus, it is possible to generate an addressing discharge without increasing the addressing discharge starting voltage, even when the height of the partition wall 156, the proportion of xenon gas in the discharge gas or the film thickness of the dielectric layer 2 is increased in order to enhance the luminous efficiency of the display discharge generated between the display electrodes X4 and Y4.

The mechanism for reducing the addressing-discharge starting voltage is approximately the same as that in the PDP of the first embodiment.

Further, as in the first embodiment, it is possible in the fifteenth embodiment to further reduce the addressing-discharge starting voltage by means of mixing trace hydrogen into the discharge gas.

Figure 19:
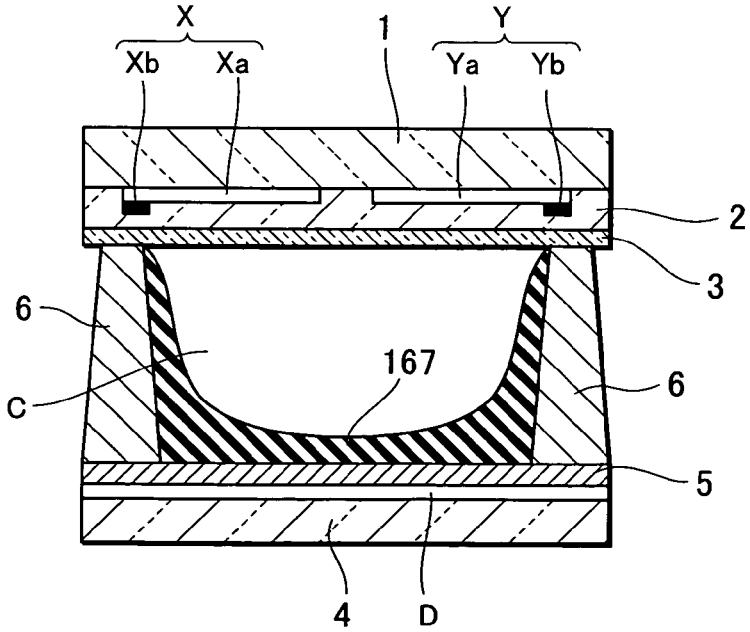
FIG. 19 is a sectional view illustrating a sixteenth embodiment of a PDP according to the present invention.

FIG. 19 is a sectional view illustrating a sixteenth embodiment of the PDP according to the present invention.

The PDP in the sixteenth embodiment is a reflection type surface discharge PDP as in the case of the PDP in the first embodiment. The structure, except for the phosphor layer, is approximately the same as that in the first embodiment and is denoted by the same reference numerals.

The PDP in the sixteenth embodiment has diamond-containing layers 167 formed by adding diamond powder individually to the red-, green- and blue-colored phosphor materials. The diamond-containing layer 167 serves as a phosphor layer and is provided over the surface of the addressing electrode protective layer 5 and the side faces of the partition wall 6.

Regarding the particle size of the diamond powder, the impurities included in the diamond powder, the terminal form of the diamond powder, the characteristics relating to the polarity of the addressing electrode D, and the like, the diamond-containing layer 167 is approximately the same as in the case of the first embodiment.

The diamond-containing layer 167 is formed preferably by use of a CVD process, but alternatively, can be formed by use of screen printing techniques or various techniques such as ink jetting, nozzle discharging, spin coating, and the like.

In the PDP, an addressing discharge between the display electrode Y and the addressing electrode D is produced on both sides the diamond-containing layer 167. Therefore, the addressing discharge is generated at a low addressing discharge starting voltage because of the diamond powder included in the diamond-containing layer 167. Thus, it is possible to generate an addressing discharge without increasing the addressing discharge starting voltage, even when the height of the partition wall 6, the proportion of xenon gas in the discharge gas or the film thickness of the dielectric layer 2 is increased in order to enhance the luminous efficiency of the display discharge generated between the display electrodes X and Y.

When a display discharge is generated between the display electrodes X and Y, the phosphor included in the diamond-containing layer 167 is excited to emit light.

The mechanism for reducing the addressing-discharge starting voltage is approximately the same as that in the PDP of the first embodiment.

Further, as in the first embodiment, it is possible in the sixteenth embodiment to further reduce the addressing-discharge starting voltage by means of mixing trace hydrogen in the discharge gas.

A generic concept of the plasma display panel described in the aforementioned embodiments is embodied in a plasma display panel having discharge-gas-filled discharge cells each of which includes a phosphor layer formed therein and is formed between two substrates, and producing a display discharge between paired display electrodes and an addressing discharge between one of the paired display electrodes and an addressing electrode in each discharge cell. The plasma display panel includes a diamond-containing layer made of an insulation material containing diamond, and formed in a position where the addressing discharge is produced between the display electrode and the addressing electrode in the discharge cell.

With the plasma display panel according to the generic concept of the plasma display panel, when an addressing discharge is generated between the addressing electrode and one of the paired display electrodes in each discharge cell, the diamond included in the diamond-containing layer formed in a portion in which the addressing discharge is generated in each discharge cell stimulates the emission of secondary electrons from the discharge gas. This makes it possible for the addressing discharge to be generated at a low addressing-discharge starting voltage.

Even when the space between the two substrates is widened, the proportion of xenon gas in the discharge gas is increased, or the dielectric layer covering the display electrodes is increased in film thickness, in order to improve the luminous efficiency of the display discharge in the discharge cell, it is possible to produce an addressing discharge without increasing the addressing-discharge starting voltage due to the diamond-containing layer The terms and description used herein are set forth by way of illustration only and are not meant as limitations. Those skilled in the art will recognize that numerous variations are possible within the spirit and scope of the invention as defined in the following claims.

What is claimed is:

1. A plasma display panel having discharge-gas-filled discharge cells each of which includes a phosphor layer formed therein and is formed between two substrates, and producing a display discharge between paired display electrodes and an addressing discharge between one of the paired display electrodes and an addressing electrode in each discharge cell, comprising:

a diamond-containing layer made of an insulation material containing diamond, and formed in a position where the addressing discharge is produced between the one of the paired display electrodes and the addressing electrode in the discharge cells, wherein the insulation material forming said diamond-containing layer is a phosphor material of the same color as that of a phosphor material forming the phosphor layer.

2. A plasma display panel according to claim 1, wherein the insulation material forming said diamond-containing layer is an insulation material different from a phosphor material forming the phosphor layer.

3. A plasma display panel according to claim 1, wherein the diamond included in said diamond-containing layer is in powder form.

4. A plasma display panel according to claim 3, wherein a particle size of the diamond powder ranges from 0.1 μm to 3 μm.

5. A plasma display panel according to claim 1, wherein the diamond is terminated by hydrogen.

6. A plasma display panel according to claim 5, wherein the diamond undergoes one of a hydrogen annealing process and a hydrogen plasma annealing process for hydrogen termination.

7. A plasma display panel according to claim 1, wherein the diamond is synthesized at high pressure, or alternatively synthesized by use of implosion techniques.

8. A plasma display panel according to claim 1, wherein the diamond include impurities.

9. A plasma display panel according to claim 8, wherein the impurities are ones selected from the group of phosphorus, nitrogen, and boron.

10. A plasma display panel according to claim 1, wherein the discharge gas includes a hydrogen gas.

11. A plasma display panel according to claim 10, wherein a concentration of the hydrogen gas in the discharge gas is equal to or less than four percentages.

12. A plasma display panel according to claim 1, wherein said diamond-containing layer includes diamond deposited by use of a Chemical Vapor Deposition process.

13. A plasma display panel according to claim 1, wherein said diamond containing layer is formed by use of one of a screen printing method, an ink jetting method, a nozzle discharging method and a spin coating method.

14. A plasma display panel according to claim 1, wherein the addressing electrode is set as a negative pole to produce the addressing discharge.

15. A plasma display panel according to claim 1, wherein one of the paired display electrodes is formed on one of the two substrates, and the other display electrode and the addressing electrode are formed on the other substrate, and said diamond-containing layer is formed in a position covering the addressing electrode.

16. A plasma display panel according to claim 15, wherein said diamond-containing layer is formed on a part of a portion of the other substrate facing the discharge cell.

17. A plasma display panel according to claim 15, wherein said diamond-containing layer is formed over the full surface of a portion of the other substrate facing the discharge cell.

18. A plasma display panel according to claim 1, wherein the paired display electrodes and the addressing electrode located close to the discharge cell with respect to the display electrodes are formed on that one of the two substrates which is located at the rear of the plasma display panel, and said diamond-containing layer is formed in a position covering the addressing electrode in the discharge cell.

19. A plasma display panel according to claim 1, wherein the paired display electrodes and the addressing electrode located close to the discharge cell with respect to the display electrodes are formed on that one of the two substrates which is located on the display screen side of the plasma display panel, and said diamond-containing layer is formed in a position covering the addressing electrode in the discharge cell.

20. A plasma display panel having discharge-gas-filled discharge cells each of which includes a phosphor layer formed therein and is formed between two substrates, and producing a display discharge between paired display electrodes and an addressing discharge between one of the paired display electrodes and an addressing electrode in each discharge cell, comprising:

a diamond-containing layer made of an insulation material containing diamond, and formed in a position where the addressing discharge is produced between the one of the paired display electrodes and the addressing electrode in the discharge cell, wherein the paired discharge electrodes are formed on one of the two substrates, and the addressing electrodes are formed on the other substrate, and said diamond-containing layer is formed in a position in the phosphor layer facing the addressing electrode.

21. A plasma display panel according to claim 20, wherein said diamond-containing layer is formed in a central position in the phosphor layer facing the addressing electrode.

22. A plasma display panel according to claim 20, wherein said diamond-containing layer is formed over the entire surface of the phosphor layer.

23. A plasma display panel according to claim 20, wherein said diamond-containing layer is formed over a central portion of the surface of the phosphor layer facing the addressing electrode.

24. A plasma display panel according to claim 20, wherein said diamond-containing layer is formed over a full face between the phosphor layer and the other substrate.

25. A plasma display panel according to claim 20, wherein said diamond-containing layer is formed between a central portion of the phosphor layer and the other substrate.

26. A plasma display panel according to claim 20, wherein the phosphor layer is constituted by a diamond-containing layer made by adding diamond to a phosphor material.

27. A plasma display panel according to claim 20, wherein the discharge cell is partitioned into a display discharge cell having the phosphor layer formed therein and provided for producing the display discharge between the paired display electrodes, and an addressing discharge cell provided for producing the addressing discharge between the one of the paired display electrodes and the addressing electrode, and said diamond-containing layer is formed in the addressing discharge cell.

28. A plasma display panel according to claim 27, further comprising a projecting part formed on the other substrate and pushing up the addressing electrode in the addressing discharge cell in a direction of the display electrode formed on the one of the substrates, wherein said diamond-containing layer is formed in a position covering the addressing electrode pushed up by the projecting part.

29. A plasma display panel according to claim 27, further comprising a ferroelectric layer formed in a position covering the addressing electrode, formed on the other substrate, in the addressing discharge cell, wherein said diamond-containing layer is formed on the ferroelectric layer.

* * * * *